US005609204A

United States Patent [19]

Rebardi et al.

[11] Patent Number: 5,609,204

[45] Date of Patent: Mar. 11, 1997

[54] ISOLATION SYSTEM AND GRAVEL PACK ASSEMBLY

[75] Inventors: Wade Rebardi, Carencro; Donald H. Michel, Broussard, both of La.

[73] Assignee: OSCA, Inc., Lafayette, La.

[21] Appl. No.: 368,964

[22] Filed: Jan. 5, 1995

[51] Int. Cl.[6] ..... E21B 43/08

[52] U.S. Cl. ..... 166/51; 166/227; 166/332.4

[58] Field of Search ..... 166/51, 318, 332, 166/296, 227

[56] References Cited

U.S. PATENT DOCUMENTS

| | | | |
|---|---|---|---|
| 2,419,313 | 4/1947 | Byrd | 166/296 X |
| 3,071,195 | 1/1963 | Raulins | 166/332 |
| 3,741,300 | 6/1973 | Wolff et al. | 166/184 |
| 3,768,562 | 10/1973 | Baker | 166/289 |
| 4,401,158 | 8/1983 | Spencer et al. | 166/51 |
| 4,627,488 | 12/1986 | Szarka | 166/51 |
| 4,858,690 | 8/1989 | Rebardi et al. | 166/278 |
| 5,137,088 | 8/1992 | Farley et al. | 166/318 X |
| 5,174,379 | 12/1992 | Whiteley et al. | 166/318 X |
| 5,295,538 | 3/1994 | Restarick | 166/205 |
| 5,332,038 | 7/1994 | Tapp et al. | 166/278 |

*Primary Examiner*—Hoang C. Dang

*Attorney, Agent, or Firm*—Woodard, Emhardt, Naughton Moriarty & McNett

[57] ABSTRACT

An isolation system is disclosed which includes a production screen and an internal isolation pipe sealed with the production screen at proximal and distal ends, and an internal sleeve slideably coupled with the isolation pipe. The isolation pipe defines at least one port and the sleeve defines at least one aperture, and the sleeve is moveable between an open position in which the port and aperture are in communication to permit fluid flow therethrough, and a closed position in which the port and aperture are not in communication and fluid flow is prevented. The sleeve is manipulated by a service string and multi-action shifting tool between the opened and closed positions. Also disclosed is a gravel packer and method of operation incorporating the isolation system, as well as a service tool and service string assembly useful therewith.

2 Claims, 3 Drawing Sheets

ISOLATION SYSTEM AND GRAVEL PACK ASSEMBLY

BACKGROUND OF THE INVENTION

1. Field of the Invention

The present invention relates to the field of isolation systems and gravel pack assemblies for use in a wellbore. More particularly, the invention provides an improved system and method for zone isolation following gravel pack completions installed in a wellbore.

2. Description of the Prior Art

The present invention provides an isolation sleeve which is installed inside the production screen at surface and thereafter controlled in the wellbore by means of an inner service string. In contrast, the prior art has used systems which involve intricate positioning of tools which are installed down-hole after the gravel pack.

These systems are exemplified by a commercial system available from Baker. This system utilizes an anchor assembly which is run into the well bore after the gravel pack. The anchor assembly is released by a shearing action, and subsequently latched into position.

Certain disadvantages have been identified with the systems of the prior art. For example, prior conventional isolation systems have had to be installed after the gravel pack, thus requiring greater time and extra trips to install the isolation assemblies. Also, prior systems have involved the use of fluid loss control pills after gravel pack installation, and have required the use of thru-tubing perforation or mechanical opening of a wireline sliding sleeve to access alternate or primary producing zones. In addition, the installation of prior systems within the wellbore require more time consuming methods with less flexibility and reliability than a system which is installed at the surface.

There has therefore remained a need for an isolation system for well control purposes and for well bore fluid loss control which combines simplicity, reliability, safety and economy, while also affording flexibility in use. The present invention satisfies this need, providing an isolation system which does not require the running of tailpipe and isolation tubing separately. Instead, the present system uses the same pipe to serve both functions: as tailpipe for circulating-style treatments and as production/isolation tubing.

SUMMARY OF THE INVENTION

Briefly describing one aspect of the present invention, there is provided an isolation assembly which comprises a production screen, an isolation pipe mounted to the interior of the production screen, the isolation pipe being sealed with the production screen at proximal and distal ends, and a sleeve movably coupled with the isolation pipe, the isolation pipe defining at least one port and the sleeve defining at least one aperture, the sleeve having an open position with the aperture of the sleeve in fluid communication with the port in the isolation pipe, the sleeve in the open position permitting fluid passage between the exterior of the screen and the interior of the isolation pipe, the sleeve also having a closed position with the aperture of the sleeve not in fluid communication with the pork of the isolation pipe, the sleeve in the closed position preventing fluid passage between the exterior of the screen and the interior of the isolation pipe. The present invention also provides a complementary service string and multi-action shifting tool useful in combination with the isolation system. In a further embodiment there is provided an overall isolation and production screen assembly in combination with a gravel packer assembly. In addition, the present invention contemplates methods for use of the foregoing assemblies in a wellbore.

It is an object of the present invention to provide a versatile isolation system that combines simplicity, reliability, safety and economy with optional methods of operation.

Another object of the present invention is to provide an isolation system permanently installed inside the production screen at surface prior to running into the well.

It is a further object to provide an isolation system which is simpler to install and operate, and which provides an immediate shut off to the zone of interest, allowing a better means for fluid loss and pressure control.

Further objects of the present invention include the provisions of an overall isolation and production screen assembly in combination with a gravel packer assembly, as well as a complementary service tool and service string assembly, and methods for the use thereof ho provide a system having improved utility over the prior art.

Further objects and advantages of the present invention will be apparent from the description of the preferred embodiment which follows.

DESCRIPTION OF THE PREFERRED EMBODIMENT

Figure 1:
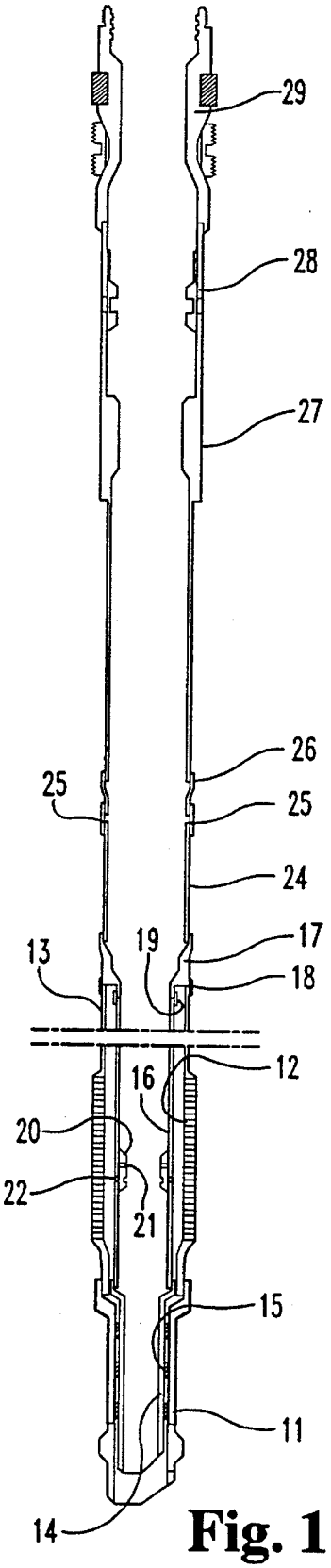
FIG. 1 is a side, cross-sectional, diagrammatic view of an isolation system and gravel pack assembly in accordance with the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

In accordance with the present invention, an isolation system is provided which is installed prior to running the system into the wellbore. This yields a simpler and easier installation with advantages also in respect to the subsequent operation of the system. A valve system is mounted within the production screen and forms an integral part of the graver pack assembly, thereby avoiding the need for a separate isolation system to be run separately into the well.

In the preferred embodiment, an isolation pipe and sliding valve sleeve are permanently coupled with the production screen at surface prior to running into the well. For normal operations, the isolation valve is initially fixed in the open position. When the gravel pack procedure is complete, an inner service string is manipulated to close the valve prior to pulling the gravel pack service tools from the wellbore. The isolation pipe assembly can be positively tested to insure integrity when required, and subsequent manipulation of the isolation sleeve permits the zone to be selectively opened or closed.

The isolation system of the present invention is useful in connection with conventional gravel packer systems. In general, the system comprises a combination of an isolation system mounted within a production screen. The isolation system is sealed at the proximal and distal ends of the production screen and provides a valving action such that shutting off the isolation system prevents fluid communication from the exterior of the production screen to the interior of the isolation system. The isolation system may therefore be configured in a variety of ways to accomplish this valving action. One such isolation system useful in accordance with the present invention is known as the Reservoir Isolation Valve or R.I.V., available from Tube-Alloy Corporation.

In FIGS. 1–6 there is provided a diagrammatic view of an embodiment of the present invention. FIG. 1 shows an improved isolation/screen assembly 10 in accordance with the present invention incorporated into an overall gravel packer assembly. In this embodiment, the isolation assembly 10 includes a locater seal 11 with an exterior concentric seal assembly. The seal is threaded to a production screen 12, which is typically coupled to a section of blank pipe 13.

Received within the seal 11 is a collet 14 having external, concentric seal assemblies 15 providing a fluid tight seal with the seal 11 at the distal end of the isolation/screen assembly. Collet 14 is threaded to an isolation pipe 16. Blank pipe 13 and isolation pipe 16 are in turn secured to a coupling 17 by means of collars 18 and 19, respectively, threaded to the coupling. Therefore, the isolation pipe is sealed on both the proximal and distal sides of the production screen, and fluid communication from the exterior of the production screen to the interior of the isolation pipe is controlled by the isolation pipe.

Shown somewhat in diagrammatic form in the figures is a valve member or sleeve 20 which is received within and movably mounted to the isolation pipe 16. Sleeve 20 defines at least one aperture 21 which is alignable with one or more ports 22 in the isolation pipe, thereby providing fluid communication therewith when the aperture 21 is aligned with port(s) 22. The sleeve 20 has an open position with aperture 21 in fluid communication with the port 22, permitting fluid to pass from exterior of the screen 12 to interior of the isolation pipe 16. The sleeve also has a closed position in which the aperture 21 is not in fluid communication with a port 22. The closed position of the sleeve combines with the proximal end connections at coupling 17 and the distal end sealing by the seal assemblies 15 to prevent fluid communication from exterior of the screen to interior of the isolation pipe.

Figure 4:
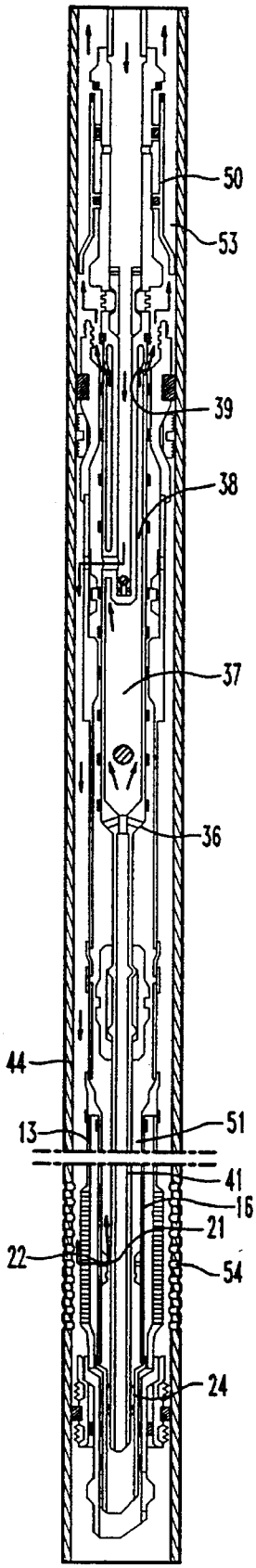
FIG. 4 is a side, cross-sectional, diagrammatic view of the isolation and gravel pack assembly and of the service tool and service string assembly in the circulating position.

In typical use, the isolation/screen system is incorporated in an overall gravel packing assembly 23, also shown in FIG. 1. The coupling 17 is threadedly coupled through blank pipe 24 and collar 25 to a shearout safety joint 26. This joint is in turn coupled by threaded engagement to a lower seal bore 27, perforated extension 28 and gravel packer 29. In conventional fashion, the gravel packer 29 includes a threaded proximal end for reception of a complementary hydraulic setting tool (FIG. 4).

Figure 2:
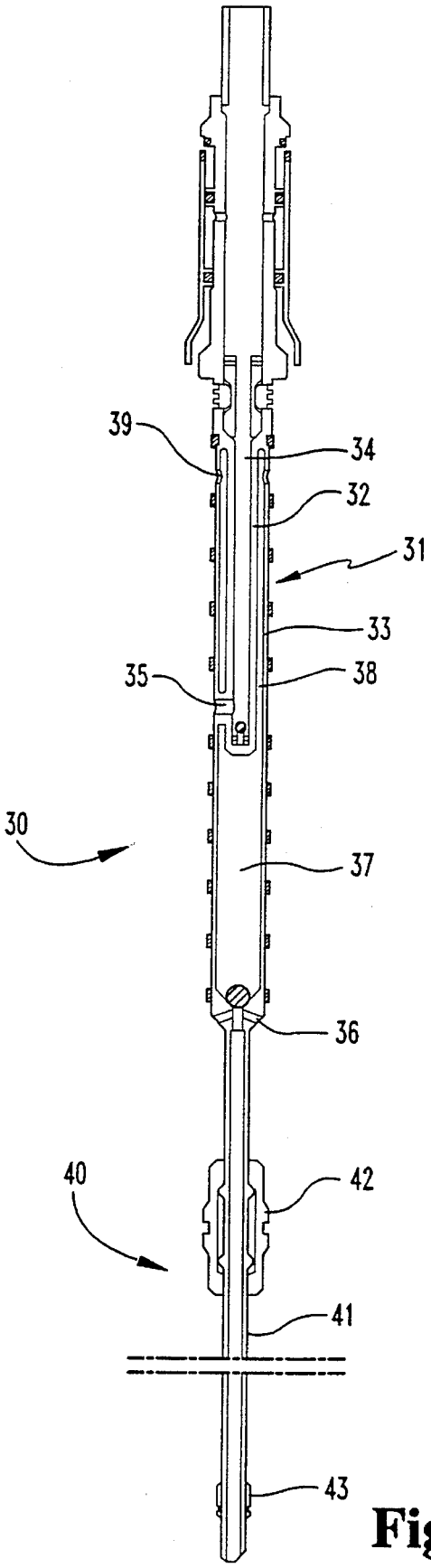
FIG. 2 is a side, cross-sectional, diagrammatic view of a service tool and service string assembly useful with the present invention.

Useful with the isolation system and gravel packing assembly of the present invention is the service tool and service string assembly 30 shown in FIG. 2. The overall service tool/string assembly includes a crossover assembly 31. The crossover assembly provides control of fluid flow paths in cooperation with other components inserted into the wellbore. The crossover assembly includes an inner pipe 32 which extends for a portion of the proximal part of an outer pipe 33. Inner pipe 32 defines a central lumen 34 which communicates through aperture 35 to the exterior of outer pipe 33 at a location intermediate the length of the outer pipe. In addition, outer pipe 33 defines a plurality of apertures 36 which communicate from the exterior of the outer pipe at its distal end to an interior chamber 37, which in turn communicates through an annular portion 38 and holes 39 to the exterior of the outer pipe at its proximal end.

Extending distally from the crossover assembly is a service string 40 which operates in cooperation with the isolation system. The service string 40 includes a cylindrical member 41 which carries a position indicator 42 and a multi-action shifting tool 43. The position indicator 42 works in conjunction with the lower seal bore 27 (FIG. 1) and is useful for indicating the position of the shifting tool 43. The shifting tool is used with the sleeve 20 on the isolation pipe 16 to move the sleeve between opened and closed positions, as described hereafter.

The isolation and gravel pack assembly and the service tool/string assembly are assembled using conventional techniques, and are used in combination to establish a wellbore gravel pack system having enhanced operating capabilities. The overall system is operable in several different modes, including squeezing, circulating, reversing and production, as described hereafter. It is a particular advantage of the present invention that the isolation system is permanently attached with the production screen, and that means are provided for readily switching from a closed, isolation condition to an open, production condition.

Given the foregoing description of the novel isolation system and associated components, the assembly of the various assemblies will be within the ordinary skill in the art. Therefore, only a brief summary of the assembly process is provided hereafter.

Figure 3:
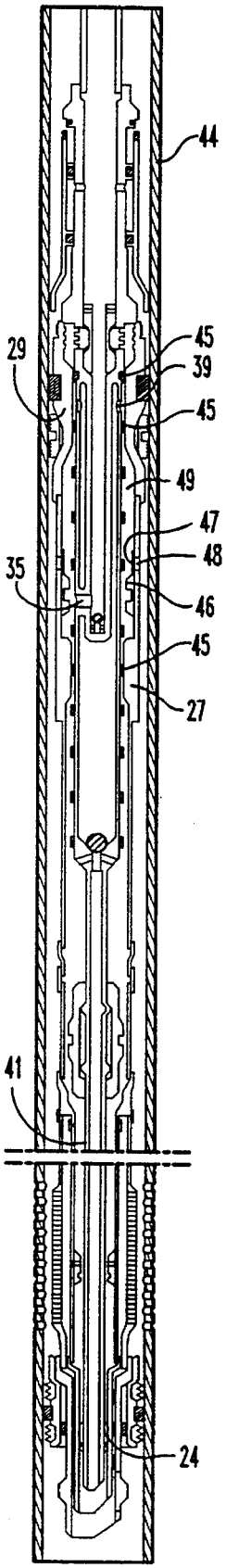
FIG. 3 is a side, cross-sectional, diagrammatic view of the isolation and gravel pack assembly and of the service tool and service string assembly in the squeezing position.

In a preferred method, the system is inserted in typical fashion into a wellbore defined by casing 44 (FIG. 3). In the assembly process, the assembly 11, for example a bull-plug or latch type seal assembly for-a sump packer, is made up to the bottom of a sand control production screen 12 designed for the size and weight casing 44 in which the assembly is to be installed. Most assemblies will be run until one joint of blank pipe 13 is above the production screen. As is well understood, the assembly of these and other components is typically by screw threading of the components, such as by connection of the production screen 12 with blank pipe 13.

At this point, the packing assembly is positioned on the rotary table and it is ready for installation of the isolation assembly. In the embodiment of FIGS. 1–6, the isolation assembly consists of the collet 14 and concentric seal assemblies 15 attached to the isolation pipe 16. This isolation pipe in turn carries the isolation sleeve 20, initially in the opened position. The isolation assembly is permanently installed into the production screen and blank pipe assembly at the surface of the well. Remaining blank pipe is installed as needed until the gravel pack packer assembly is ready to be installed thereon.

Once the blank pipe is installed, then the multi-action shifting tool 43 is made up on the bottom of the service string 40 and run inside the production screen/blank pipe and inside the fixed isolation assembly. The shifting tool 43 is positioned below the isolation sleeve 20 during installation of the gravel packer.

The service tool/string is then made up to the internal service string and lowered to mate up with the screen/blank pipe assembly 10. The entire gravel pack assembly is mated up with the rig work string and lowered into the wellbore for installation. Typical packer setting and gravel pack procedures are followed until the operator is ready to remove the gravel pack service tool and service string from the wellbore.

The packer is seated using pump pressure applied to the tubing. After the packing is seated, the crossover assembly may be opened and closed as desired to control fluid flow. With the crossover assembly closed, the packer may be pressure tested by pumping down the casing. Pumping down the tubing and into the formation is done to establish injection rate. With the crossover assembly open, a sand slurry may be circulated to place sand outside the screen and into the formation until an adequate gravel pack is obtained. If desired, the crossover may be closed to obtain a conventional squeeze pack.

The initial assembly of the systems and the placement in the wellbore provides a squeezing position as shown in FIG. 3. The crossover assembly carries a series of concentric seals 45 which are operable to seal with the interior of the lower seal bore 27 and locations along the interior of the gravel packer 29. In the position of FIG. 3, the crossover assembly is located to seal with the lower seal bore 27, and also to seal with the gravel packer 29 on both sides of holes 39. A closing sleeve 46 is mounted to the perforated extension 28 and includes apertures 47 which may be moved into and out of alignment with perforations 48 in the extension.

In the squeezing position, the closing sleeve is in the open position with the apertures 47 aligned with the perforations 48. Therefore, fluid pumped through the central lumen 34 can move through aperture 35 into an annular cavity 49. The fluid then may pass through apertures 47 and perforations 48 to the space between the packer assembly and casing.

A circulating condition is established when the gravel pack service tool is displaced upwardly, as shown in FIG. 4. A hydraulic setting tool 50 is used in conventional fashion to separate the service tool 31 from the gravel packer 29 and the service tool is displaced upwardly to the position of FIG. 4. In this position, the holes 39 are not sealed with the gravel packer, and fluid is free to flow outwardly through the holes 39 to the area along the casing interior above the gravel packer. In this circulating position, fluid may be forced downwardly through the central lumen 34 and along the route described with respect to the squeezing position of FIG. 3. However, since the holes 39 are not sealed, fluid can travel through the annular space 51 between the service string and the isolation pipe and through the interior chamber 37 and eventually through the holes 39 to the region above the gravel packer. In particular, fluid passes down through the annular space 52 between the blank pipe 13 and the casing 44 and passes successively through the screen 12, port 22 and aperture 21 to the annular space 51. The fluid then moves upwardly past the location indicator 42 and through apertures 36 into the interior chamber 37. From here the fluid flows through the annular portion 38 and out the holes 39 into the annular region 53 outside and above the hydraulic setting tool 50.

It will be appreciated that the circulating position is useful for delivering wellbore fluids, i.e. completion fluids, and sand down to the region of the production screen 12 and the perforations 54 in the casing. As is conventional, a sand slurry is delivered in an amount to fill the area outside the screen, and to some extent outside the casing, up to a level at least slightly above the top of the production screen. If desired, the crossover may be closed (FIG. 3) to obtain a conventional squeeze pack.

The circulating operation is distinguished from the prior ark in that the circulation pattern is not through the interior of the service string 41. In the past, the lower part of the service string has comprised a hollow wash pipe. In the circulating position, the distal end of the wash pipe has been located above the sump packer, generally in the region of the production screen. In this configuration, fluid flow in tile circulating position has occurred upwardly through the interior of the wash pipe. In contrast, the present invention utilizes a circulating flow pattern in which the fluid passes through the annular space 51 between the service string 41 and the isolation pipe 16. Consequently, the radially extending apertures 36 provide for fluid communication from this annular space 51 to the interior chamber 37.

Figure 5:
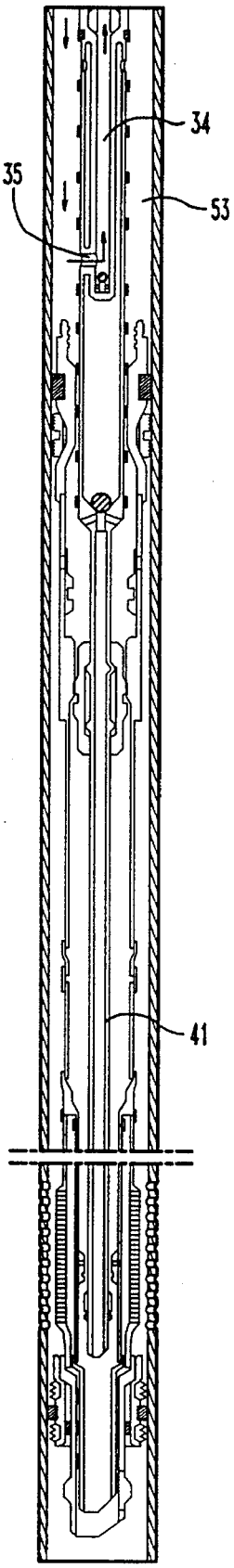
FIG. 5 is a side, cross-sectional, diagrammatic view of the isolation and gravel pack assembly and of the service tool and service string assembly in the reversing position.

A reversing position is shown in FIG. 5. In this condition, fluid is able to flow through the aperture 35 between the central lumen 34 and the annular region 53. This position is useful for removing excess sand slurry and completion fluids from the aperture 35 and the central lumen 34 of the crossover assembly. This provides protection for the formation from circulation pressure and possible loss of completion fluid.

Figure 6:
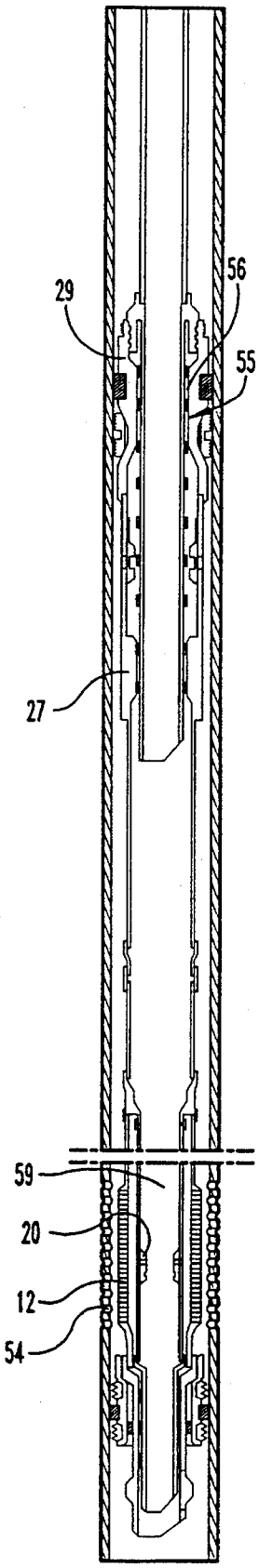
FIG. 6 is a side, cross-sectional, diagrammatic view of the isolation and gravel pack assembly with the service tool and service string assembly removed and with a production assembly inserted for operation in the production position.

After removal of the service tool and service string, a production seal assembly is run in for production of the zone. As the service string 40 is removed from the wellbore, the shifting tool 43 automatically moves the sleeve 20 to the closed position. This isolates the production zone during the time that the production seal assembly is being run into the well. As shown in FIG. 6, the production seal assembly 55 includes production tubing 56 which carries concentric seal assemblies 57. The seal assemblies provide a fluid tight seal between the production tubing and the lower seal bore 27 and packer 29.

Once the production seal assembly is in position as shown in FIG. 6, a service string or wireline is run into the wellbore to shift the sleeve 20 to the open position (as shown, for example, in FIG. 4). The well is then in condition for production from the zone. In particular, material moves through the perforations 54 in the casing, through the production screen 12 and the aligned ports 22 and apertures 21 into the central passageway 59. The material then moves upwardly through the interior of the production tubing 56.

Thereafter, the isolation assembly may be used to selectively open and close the production zone as required. A service string with multi-action shifting tool is used to selectively raise (close) or lower (open) the sleeve 20 relative the isolation pipe 16.

It will be appreciated that the foregoing description relates to a somewhat simplified and diagrammatic view of the isolation system and related components. As is well understood in the art, these components may include a multiplicity of members interconnected in conventional fashion, e.g. by threaded connection. For example, items shown as a single pipe may comprise several pipes connected together with threaded couplings to provide an overall member of desired length.

Figure 7:
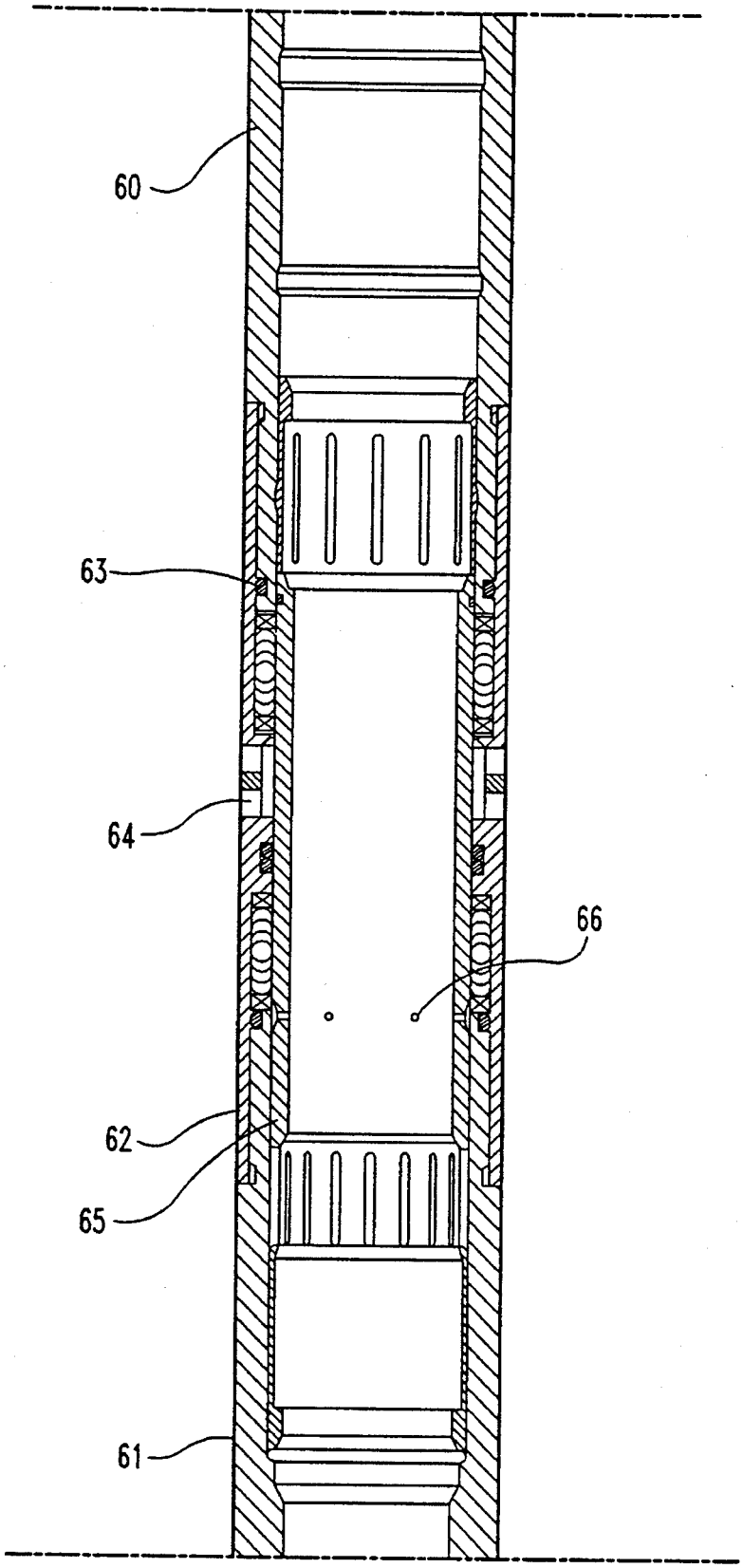
FIG. 7 is a side, cross-sectional view of an alternate form of an isolation system useful in accordance with the present invention.

Similarly, the particular configuration of the isolation/production screen assembly can vary. A particular aspect of the assembly being that the isolation system is secured to the production screen and sealed both proximally and distally of the screen. As mentioned, a convenient isolation system for use with the present invention is available commercially as the Reservoir Isolation Valve, or R.I.V. An R.I.V. is shown in FIG. 7. The R.I.V. assembly 60 comprises top and bottom pipes 61 and 62 coupled together by cylindrical body 63 through threaded connections and sealed therewith by o-ring seals 64. The body 63 defines holes 65 in communication with the exterior of the assembly. A sleeve 66 is received within the assembly and defines several ports 66. The sleeve has an open position in which the ports 66 are in fluid communication with the holes 64, and a closed position in which the ports are not in communication.

The present invention provides an isolation system and method which has distinct advantages. The system permits the installation of as many independent zone isolation systems as necessary, without restrictions to production. Gravel packing can be accomplished with the isolation tubing in place. Access to the zone is permitted by simple activation of the isolation sleeve by means of a service string. In addition, the integrity of the isolation assembly can be pressure tested prior to coming out of the wellbore with the service tools.

The shut off of wellbore fluids into the producing zone is accomplished by way of a permanent isolation assembly. Pressure depleted zones can be isolated immediately after gravel pack installation. In multiple zone completions, higher pressure zones can similarly be isolated immediately after gravel pack installation.

In practice, the system avoids the need for prior conventional isolation strings that had to be installed after the gravel pack, thereby eliminating complex space outs, and the extra trips to install isolation assemblies. The system eliminates fluid loss control pills after gravel pack installation. The system also eliminates the need to thru-tubing perforate to access alternate or primary producing zones, while thru-tubing perforation is available as a back-up.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An isolation assembly which comprises:

a cylindrical production screen having a proximal end and a distal end, said screen defining an area of fluid passage between a screen interior and a screen exterior;

an isolation pipe defining at least one port therethrough, said isolation pipe having a proximal end and a distal end, at least one of the proximal and distal ends being affixed to said production screen;

first sealing means for sealing the proximal end of said isolation pipe with said production screen;

second sealing means for sealing the distal end of said isolation pipe with said production screen;

a sleeve movably coupled with said isolation pipe, said sleeve defining at least one aperture, said sleeve having an open position with the aperture of said sleeve in fluid communication with the port in said isolation pipe, said sleeve having a closed position with the aperture of said sleeve not in fluid communication with the port of said isolation pipe, said sleeve in the open position permitting fluid passage between the exterior of said screen and the interior of said isolation pipe, said sleeve in the closed position preventing fluid passage between the exterior of said screen and the interior of said isolation pipe;

an isolation pipe extension defining at least one port therethrough, said isolation pipe extension having a proximal end and a distal end, said distal end affixed to the proximal end of said production screen;

a closing sleeve movably coupled with said isolation pipe extension, said closing sleeve defining at least one aperture, said closing sleeve having an open position with the aperture of said closing sleeve in fluid communication with the port in said isolation pipe extension, said closing sleeve having a closed position with the aperture of said closing sleeve not in fluid communication with the port of said isolation pipe extension, said closing sleeve in the open position permitting fluid passage between the exterior of said isolation pipe extension and the interior of said isolation pipe extension, said closing sleeve in the closed position preventing fluid passage between the exterior of said isolation pipe extension and the interior of said isolation pipe extension; and a lower seal bore affixed to said isolation pipe extension between said at least one port and the distal end of said isolation pipe extension.

2. The isolation assembly of claim 1 wherein said sleeve is configured to engage a multi-action shifting tool, said multi-action shifting tool moving the sleeve between the open and closed positions.

* * * * *

UNITED STATES PATENT AND TRADEMARK OFFICE

CERTIFICATE OF CORRECTION

PATENT NO. : 5,609,204

DATED : March 11, 1997

INVENTOR(S) : Wade Rebardi and Donald H. Michel

It is certified that error appears in the above-indentified patent and that said Letters Patent is hereby corrected as shown below:

In col. 1, line 62, please change "pork" to --port--.

In col. 2, line 20, please change "ho" to --to--.

In col. 4, line 54, please delete the hyphen.

In col. 6, line 16, please change "ark" to --art--.

In col. 6, line 21, please change "tile" to --the--.

Signed and Sealed this

Twenty-third Day of September, 1997

*Attest:*

Bruce Lehman

BRUCE LEHMAN

*Attesting Officer*

*Commissioner of Patents and Trademarks*